US007188438B1

(12) United States Patent
Bowen

(10) Patent No.: US 7,188,438 B1
(45) Date of Patent: Mar. 13, 2007

(54) STEP-IN/STEP OUT OVERSHOE

(75) Inventor: David Bowen, Binghamton, NY (US)

(73) Assignee: 311 Industries, Inc., Endicott, NY (US)

( * ) Notice: Subject to any disclaimer, the term of this patent is extended or adjusted under 35 U.S.C. 154(b) by 60 days.

(21) Appl. No.: 11/050,099

(22) Filed: Feb. 3, 2005

(51) Int. Cl.
*A43B 3/10* (2006.01)
*A43B 3/12* (2006.01)

(52) U.S. Cl. ..... 36/7.1 R; 36/58.5; 36/138; 36/7.5

(58) Field of Classification Search ..... 36/7.1 R, 36/7.2–7.5, 58.5, 58.6, 138
See application file for complete search history.

(56) References Cited

U.S. PATENT DOCUMENTS

| | | | | | |
|---|---|---|---|---|---|
| 11,947 | A | * | 11/1854 | Pease | 36/3 A |
| 369,766 | A | * | 9/1887 | Barney | 36/58.5 |
| 395,271 | A | * | 12/1888 | Fry | 36/58.6 |
| 875,144 | A | * | 12/1907 | Bourn | 36/58.5 |
| 879,306 | A | * | 2/1908 | O'Sullivan | 36/58.6 |
| 2,268,435 | A | | 12/1941 | Zucker | |
| 2,436,234 | A | | 2/1948 | Stein | |
| 2,602,724 | A | | 7/1952 | Batchelor | |
| 2,825,155 | A | * | 3/1958 | Hines | 36/58.6 |
| 2,860,425 | A | * | 11/1958 | Jackson | 36/7.3 |
| 3,006,084 | A | * | 10/1961 | Le Compte | 36/7.3 |
| 3,283,423 | A | * | 11/1966 | Schovee | 36/7.3 |
| 4,246,707 | A | * | 1/1981 | Pedersen | 36/100 |
| 5,056,240 | A | | 10/1991 | Sherrill | |
| 6,189,239 | B1 | | 2/2001 | Gasparovic et al. | |
| 6,301,739 | B1 | | 10/2001 | Cazaux | |
| 6,374,449 | B1 | | 4/2002 | Jolly | |
| 6,467,192 | B1 | * | 10/2002 | Egtvedt | 36/7.3 |
| 6,557,203 | B2 | | 5/2003 | Meshbesher | |
| 2003/0136026 | A1 | * | 7/2003 | Crary | 36/58.5 |
| 2005/0066543 | A1 | * | 3/2005 | Rosen et al. | 36/7.5 |

OTHER PUBLICATIONS

International Search Report and Written Opinion mailed on Jun. 8, 2006 issued in the corresponding PCT Application.

* cited by examiner

*Primary Examiner*—Marie Patterson
(74) *Attorney, Agent, or Firm*—Grossmen, Tucker, Perreault & Pfleger, PLLC

(57) ABSTRACT

An overshoe that covers a shoe or boot for isolating the mud, dirt, grass, debris, or contaminated fluid on the shoe or boot from clean surfaces. The article has a front upright and a rear upright with built-in retaining protrusions that grab and hold onto the shoe or boot when it is inserted inside the article. A base with a fabric liner absorbs mud and liquid. The bottom of the base is provides traction and prevents slippage. The base also has a tab for easy removal of the overshoe from the shoe or boot.

19 Claims, 7 Drawing Sheets

10

10

STEP-IN/STEP OUT OVERSHOE

FIELD OF THE INVENTION

The present invention relates to footwear, and, more particularly, to an article that can be worn with a shoe or boot, thus isolating dirt, mud, grass, debris, or contaminated fluid from clean surfaces without removing the shoe or boot.

BACKGROUND OF THE INVENTION

A common problem for home makers is the tracking of dirt and/or mud from outside a dwelling into the living area thereof by work-men, children, spouses, and others. It is not unusual for a home maker to require that work-men, children, spouses, and others remove their shoes or boots to avoid contamination of the clean surfaces within the dwelling with dirt, mud, grass, debris, or contaminated fluid. This can be inconvenient when frequent entry and exit is required, or when rapid response to ringing phones or household emergencies is necessary. This inconvenience can result in missed calls, unresolved emergencies, or a lack of compliance with shoe and boot removal requirements, leading to tracking up previously clean surfaces. The inconvenience and the results thereof can also result in domestic disputes, and conflict between the involved parties.

Various shoe cleaning devices that remove dirt, mud, grass, and debris from the bottom of a shoe or boot are well known. For example, U.S. Pat. No. 2,436,234 issued to STEIN discloses a shoe cleaning device that may be affixed to a door step or porch to enable persons entering a house to first clean off the dirt or mud from the shoes. Furthermore, that device has a plurality of brushes which may be replaced from time to time.

U.S. Pat. No. 2,602,724 issued to BATCHELOR discloses a device that prevents the spread of contamination from one dairy herd to another that clings to a person's shoes and is then introduced into the food of an undiseased cow. The device also includes a sterilizing solution to kill germs carried on the shoe.

U.S. Pat. No. 6,301,739 issued to CAZAUX discloses a vehicle shoe cleaning device with removable bristles that can be mounted beneath a vehicle immediately adjacent one of the vehicle door openings.

U.S. Pat. No. 6,374,449 issued to JOLLY discloses an athletic shoe cleaner comprising an anchoring means and a plurality of spaced rods that can be secured in an earthen surface and is sufficiently rigid to remove grass, dirt and debris from the bottom of a shoe.

U.S. Pat. No. 6,557,203 issued to MESHBESHER discloses a shoe cleaning device that minimizes transmission of communicable disease by removing debris and living micro-organisms by brushing the sides and bottom of a shoe in a container with sanitizing fluid.

As indicated above, the main concern of these prior inventions is to prevent the dirt, mud, grass and debris adhering to the bottom of a shoe from depositing on a clean area. Various options include cleaning shoes by brushing, scraping, washing with disinfectant solution, etc. All of the available cleaning methods, however, have involved obvious disadvantages. Accordingly, there remains a need for a new and improved device for keeping the dirt, mud, grass and other debris on shoes or boots from contaminating a clean area.

SUMMARY OF THE INVENTION

The objective of the present invention is to provide an article that is simple and convenient to use and isolates the soiled shoe from touching a clean area. A user can wear the article with his/her shoes still on the user's feet, while walking onto a clean surface.

The article has a base with a front and rear end. The top of the base includes a liner for absorbing dirt, mud, grass, debris or contaminated fluid. The bottom of the device has a pattern that provides traction and prevents slippage. The base further includes uprights on the front and rear ends of the base. Additionally, the front and rear uprights include a plurality of holding devices that hold the article onto a shoe or boot. The front and rear uprights can be connected to form a unitary structure that is higher than the base to fully grasp the shoe and prevent any fluid leakage from the base. Moreover, a tab is molded into the base for easy removal.

Other aspects, features, and advantages of the present invention will become readily apparent from the following detailed description of the preferred embodiment when considered with the attached drawings and the appended claims.

BRIEF DESCRIPTION OF THE DRAWINGS

A complete understanding of the present invention may be obtained by reference to the accompanying drawings, when considered in conjunction with the subsequent detailed descriptions, in which.

Figure 1:
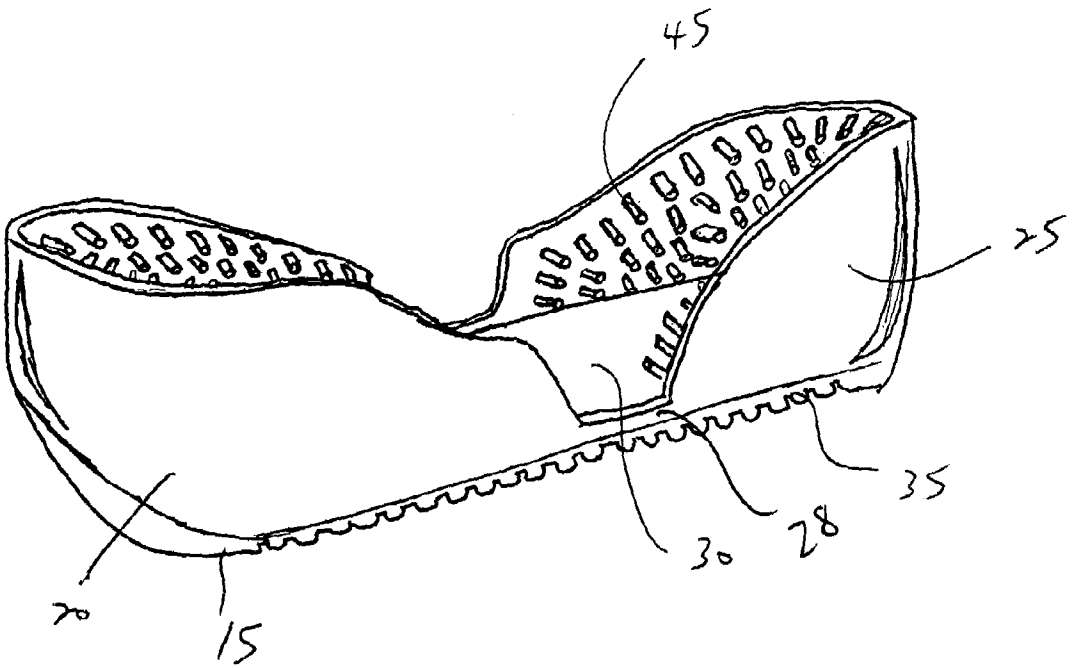
FIG. 1 is a perspective view of the overshoe article of the present invention.
Figure 2:
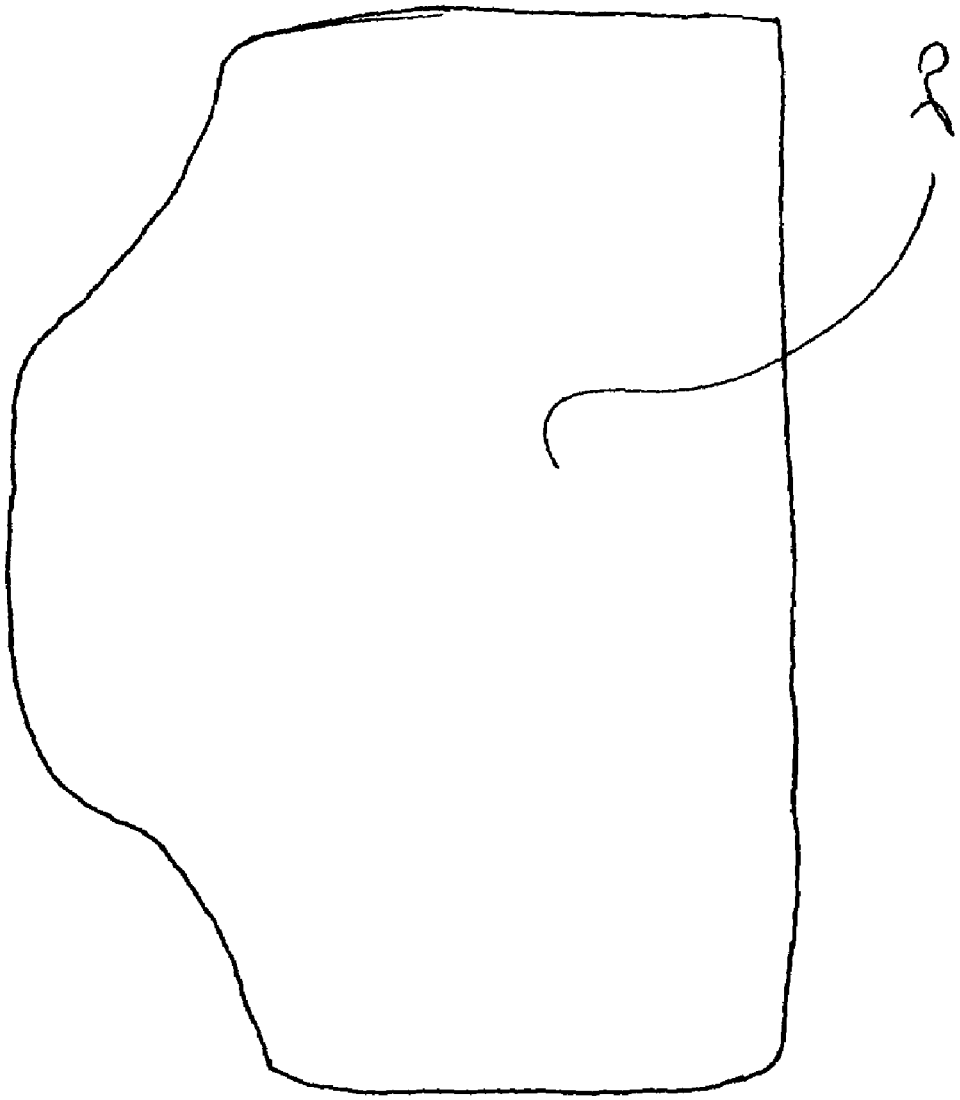
FIG. 2 is a front plan view of the article shown in FIG. 1.
Figure 3:
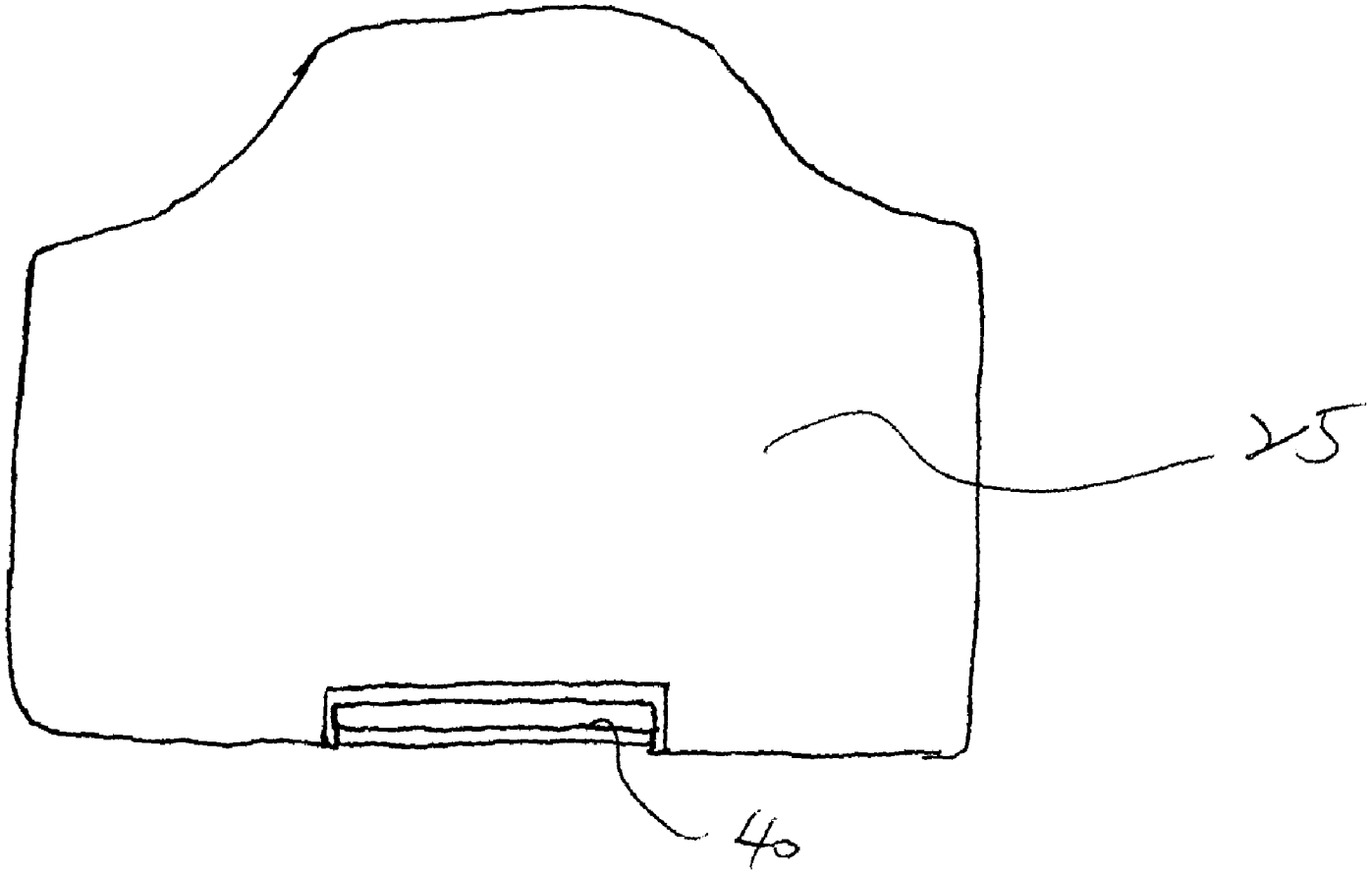
FIG. 3 is a rear plan view of the article shown in FIGS. 1 and 2.
Figure 4:
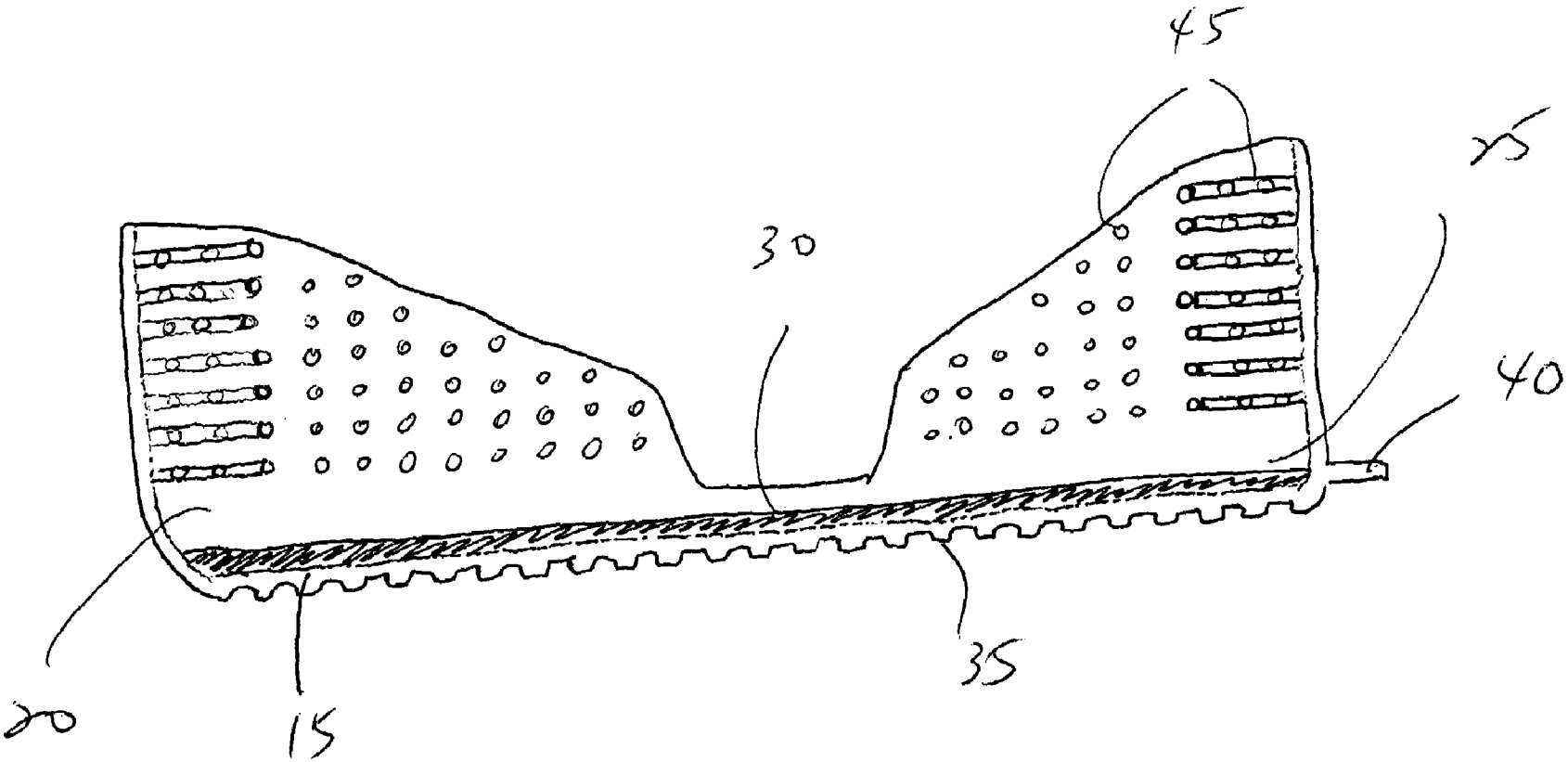
FIG. 4 is a cross-section view of the article.
Figure 5:
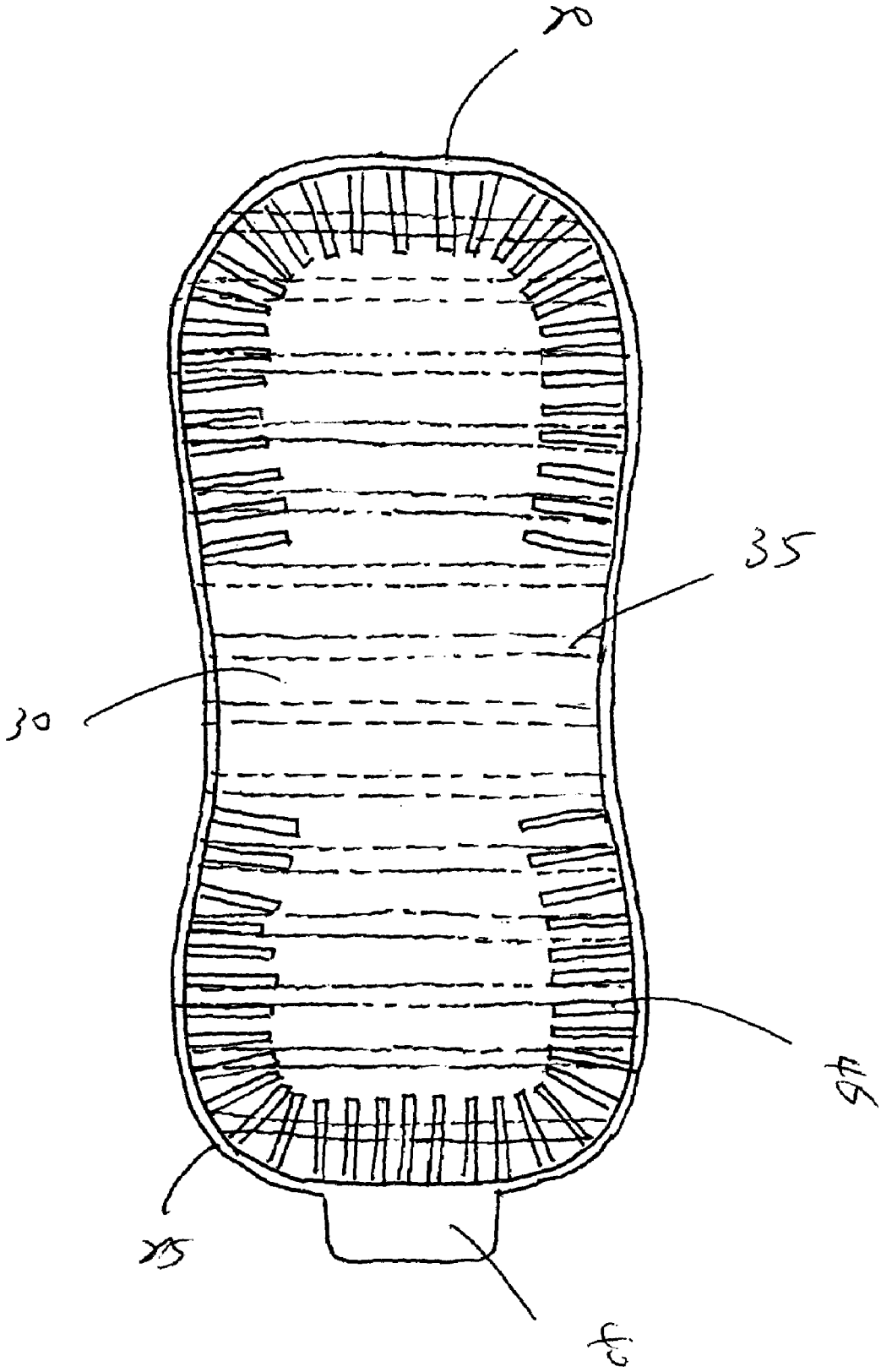
FIG. 5 is a top plan view of the article.
Figure 6:
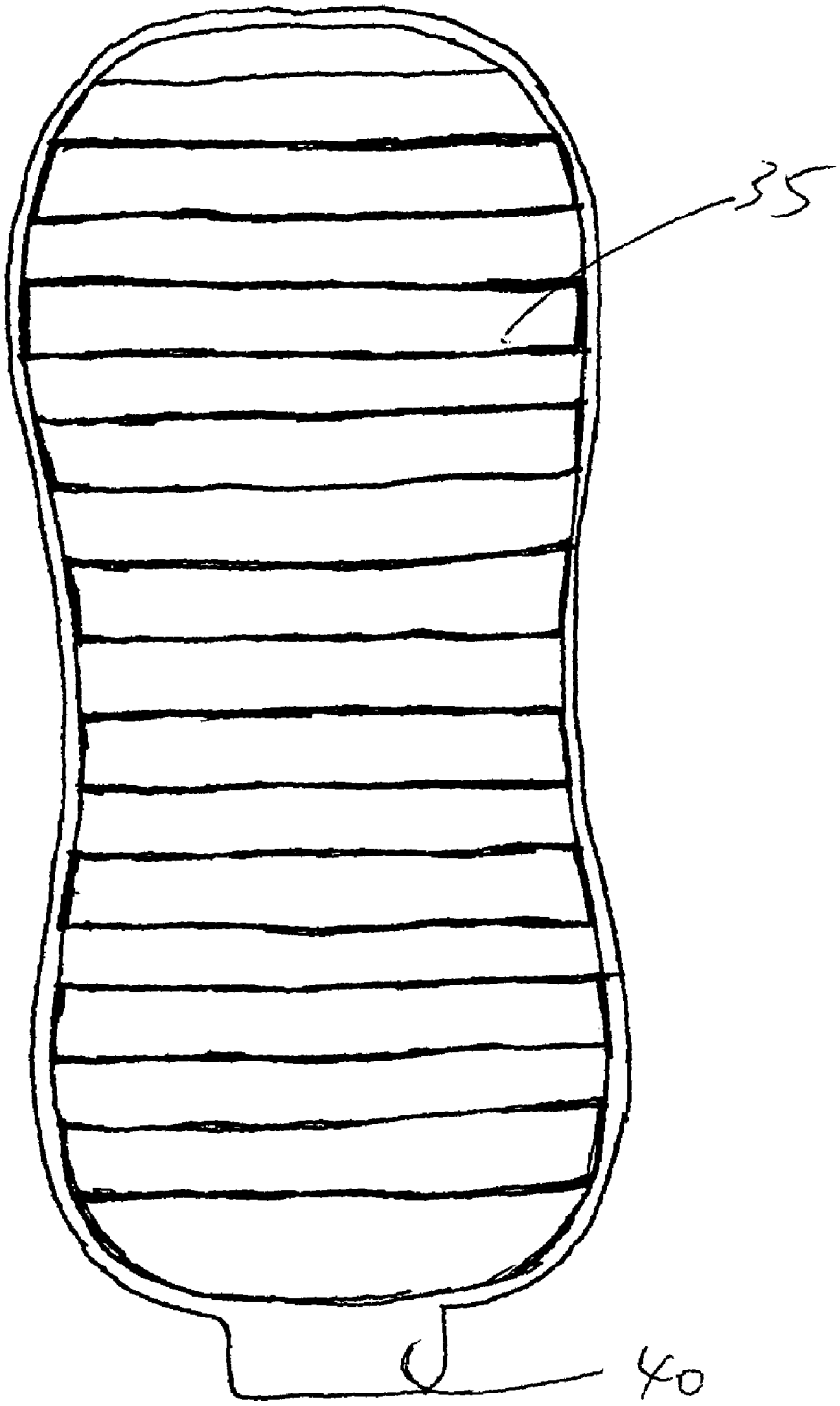
FIG. 6 is a bottom plan view of the article.
Figure 7:
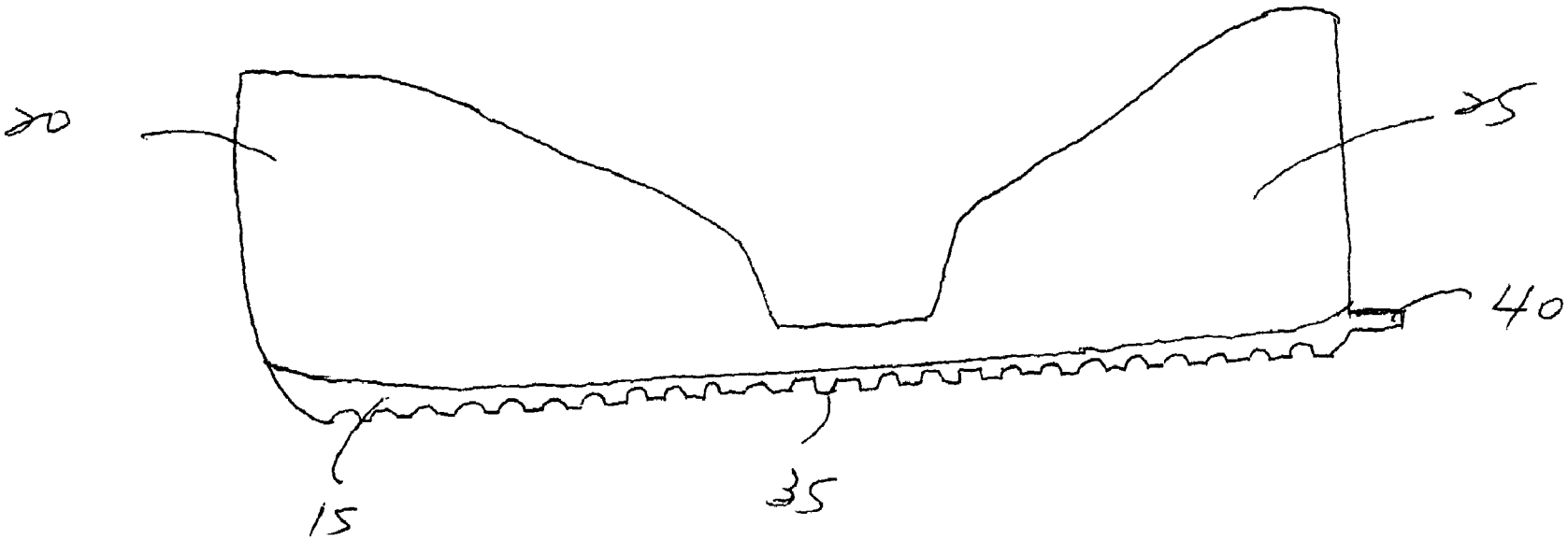
FIG. 7 is a side plan view of the article.

For purposes of brevity and clarity, like components and elements of the apparatus of this invention bear the same designations or numbering throughout the FIGURES.

DETAILED DESCRIPTION OF THE INVENTION

The present invention is simple and convenient to use and isolates the soiled shoe from touching a clean area. A user can wear the article with his/her shoes still on the user's feet, while walking onto a clean surface. The article has a base with a front and rear end. The top of the base includes a liner for absorbing dirt, mud, grass, debris or contaminated fluid. The bottom of the device has a pattern that provides traction and prevents slippage. The base further includes uprights on the front and rear ends of the base. Additionally, the front and rear uprights include a plurality of holding devices that hold the article onto a shoe or boot. The front and rear uprights can be connected to form a unitary structure that is higher than the base to fully grasp the shoe and prevent any fluid leakage from the base. Moreover, a tab is molded into the base for easy removal.

Referring now to the drawings, the invention is indicated generally by reference numeral 10. A base 15 has a front and rear upright, 20 and 25, respectively. The front and rear uprights 20 and 25 are shown connected as a unitary structure with a web 28 between the front and rear portion. Uprights 20 and 25 may be connected as one piece by bonding, integral molding, or other methods. Alternatively, each upright 20 and 25 may be attached to base 15 directly, without connection to one another. The unitary front and rear upright assembly is then attached to the base 15 by similar methods as aforementioned. The connection web 28 between the front and rear uprights 20 and 25 is slightly higher than the base 15 to prevent any loose mud or contaminated fluid, not shown, from leaking out from the overshoe. Base 15 and uprights 20 and 25 can be made of plastic, rubber, or other materials which are well known to those skilled in the art.

Attached to the upper portion of base 15 is a liner 30 for absorbing mud, dirt, grass, debris, and contaminated fluid. Liner 30 can be made of polyester or other fabrics that have strong absorption properties. Liner 30 may be attached to base 15 by glue or other adhesive materials well known in the art. The bottom of base 15 has a pattern 35 to provide traction and prevent slippage. In addition, base 15 is molded with a tab 40 for easy removal from a shoe or boot, not shown.

Front and rear uprights 20 and 25 include a plurality of retention protrusions 45 on their inside surfaces. As aforementioned front and rear uprights 20 and 25 are higher than the shoe to be inserted therein. Therefore, the shoe can be fully covered and grasped by the overshoe 10 and its retaining protrusions 45. The retaining protursions are "fingers", brushes, spikes, bristles, or other mechanisms extending perpendicularly from uprights 20 and 25. Protursions 45 may be made of plastic, rubber, or other resilient materials, preferably with relatively high durometer. Retaining protrusions 45 are integrated into the front and rear uprights 20 and 25 by molding at one time, by gluing, or by other adhesive methods.

In use, the user inserts the shoe or boot into the overshoe article. The overshoe 10 can be readily lifted with the shoe or boot by the user when the retaining protrusions 45 grasp the shoe or boot. While the shoe or boot is inside the overshoe 10, the liner 30 absorbs any dirt, mud, grass, debris, or contaminated fluid from the shoe or boot.

Since other modifications and changes varied to fit particular operating requirements and environments will be apparent to those skilled in the art, the invention is not considered limited to the examples chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. An overshoe for use with a boot or shoe to prevent contamination of a walking surface from dirt, mud, grass, debris and contaminated fluid, the overshoe comprising:

a) a shoe-shaped, planar base having a proximal end and a distal end;

b) a pair of flat uprights oppositely disposed with respect to one another and being wrapped around respective ends of said base, extending perpendicularly and linearly upwards therefrom; and c) a plurality of resilient protrusions spaced apart both vertically and horizontally with respect to one another, each of said protrusions being independently supported by a respective one of said uprights, extending substantially perpendicularly therefrom for retaining the shoe of a user when said shoe is inserted into said overshoe.

2. The overshoe in accordance with claim 1, further comprising a web disposed between and operatively connected to each of said uprights to form a unitary structure.

3. The overshoe in accordance with claim 1, further comprising an absorbent liner disposed on said base for absorbing mud and contaminated fluid.

4. The overshoe in accordance with claim 1, wherein said plurality of resilient protrusions is formed from the group of: plastic, polymer, polyester, and fabric.

5. The overshoe in accordance with claim 1, wherein said plurality of resilient protrusions consists of at least one shape from the group: cylinders, pins, posts, bristles, spirals, fructo-conical, curved, polygonal, and irregular.

6. The overshoe in accordance with claim 1, wherein said shoe-shaped, planar base has at least one dimension exceeding the outer boundary of said pair of uprights.

7. An overshoe for use with a boot or shoe to prevent contamination of a walking surface from dirt, mud, grass, debris and contaminated fluid, the overshoe comprising:

a) a planar base having a proximal end and a distal end;

b) a pair of substantially planar upwardly-oriented structures oppositely disposed with respect to one another and being wrapped around respective ends of said base; and c) a plurality of resilient protrusions spaced apart both vertically and horizontally with respect to one another, each of said protrusions being independently connected to a respective one of said upwardly-oriented structures, extending perpendicularly therefrom for retaining the shoe of a user when said shoe is inserted into said overshoe.

8. The overshoe in accordance with claim 7, further comprising a web disposed between and operatively connected to each of said upwardly-oriented structures to form a unitary structure.

9. The overshoe in accordance with claim 7, wherein said plurality of resilient protrusions is formed from the group of: plastic, polymer, polyester, and fabric.

10. The overshoe in accordance with claim 7, wherein said plurality of resilient protrusions consists of at least one shapes from the group:

cylinders, pins, posts, bristles, spirals, fructo-conical, curved, polygonal, and irregular.

11. The overshoe in accordance with claim 7, wherein said planar base has at least one dimension exceeding the outer boundary of said pair of upwardly-oriented structures.

12. An overshoe for use with a boot or shoe to prevent contamination of a walking surface from dirt, mud, grass, debris and contaminated fluid, the overshoe comprising:

a) a planar base having a periphery;

b) a substantially planar outer shoe shell having an inner surface disposed around at least a portion of said periphery of said planar base and attached thereto;

c) a plurality of resilient protrusions spaced apart both vertically and horizontally with respect to one another on, each of said protrusions being independently cantilevered on the inner surface of said outer shoe shell, extending therefrom for retaining the shoe of a user when said shoe is inserted into said overshoe.

13. The overshoe in accordance with claim 12, wherein said plurality of resilient protrusions is formed from the group of: plastic, polymer, polyester, and fabric.

14. The overshoe in accordance with claim 12, wherein said plurality of resilient protrusions consists of at least one shapes from the group: cylinders, pins, posts, bristles, spirals, fructo-conical, curved, polygonal, and irregular.

15. The overshoe in accordance with claim 12, wherein said planar base has at least one dimension exceeding said periphery of said planar base.

16. An overshoe for use with a boot or shoe to prevent contamination of a walking surface from dirt, mud, grass, debris and contaminated fluid, the overshoe comprising:

a) a resilient, shoe-shaped, substantially planar base, said base having a periphery;

b) at least one strip of resilient material having an inner surface and an outer surface, said strip of resilient material being substantially planar, said inner surface being wrapped around said periphery of said base to form said overshoe; and c) a plurality of resilient protrusions, each of said protrusions being independently affixed to said inner surface and extending perpendicularly therefrom, said protrusions being spaced apart in a grid pattern throughout said inner surface.

17. The overshoe in accordance with claim 16, wherein said plurality of resilient protrusions is formed from the group of: plastic, polymer, polyester, and fabric.

18. The overshoe in accordance with claim 16, wherein said plurality of resilient protrusions consists of at least one shape from the group: cylinders, pins, posts, bristles, spirals, fructo-conical, curved, polygonal, and irregular.

19. The overshoe in accordance with claim 16, wherein said planar base has at least one dimension exceeding said periphery of said planar base.

* * * * *